US006453475B1

(12) United States Patent
Johnson

(10) Patent No.: US 6,453,475 B1
(45) Date of Patent: Sep. 24, 2002

(54) CONVERTIBLE VISOR/CAP WITH A PLURALITY OF CROWN SUPPORTS

(76) Inventor: Jim Johnson, P.O. Box 73, Pope Valley, CA (US) 94567

( * ) Notice: Subject to any disclaimer, the term of this patent is extended or adjusted under 35 U.S.C. 154(b) by 0 days.

(21) Appl. No.: 09/714,270

(22) Filed: Nov. 17, 2000

(51) Int. Cl.[7] ..... A42B 1/06

(52) U.S. Cl. ..... 2/209.11; 2/209.12; 2/175.1; 2/195.1

(58) Field of Search ..... 2/171.1, 171.03, 2/209.11, 195.1, 209.12, 175.1, 195.2

(56) References Cited

U.S. PATENT DOCUMENTS

| | | | | |
|---|---|---|---|---|
| 276,753 A | * | 5/1883 | Bartine | 2/171.1 |
| 625,776 A | | 5/1899 | Von Klein | |
| 1,105,400 A | | 7/1914 | Burke | |
| 1,598,313 A | | 8/1926 | Rosenberg | |
| 1,665,750 A | | 4/1928 | McKee et al. | |
| 2,116,076 A | | 5/1938 | Lipton | |
| D237,758 S | | 11/1975 | Huffman | |
| 4,556,993 A | | 12/1985 | Okamura, Sr. | |
| 4,741,053 A | | 5/1988 | Okamura, Sr. | |
| 4,999,852 A | | 3/1991 | Murray | |
| 5,099,524 A | | 3/1992 | Linday | |
| 5,116,288 A | * | 5/1992 | Kondo et al. | 2/177 |
| D336,763 S | | 6/1993 | Oehlschlaeger | |
| 6,209,139 B1 | * | 4/2001 | Schmidt | 2/171.1 |

OTHER PUBLICATIONS

Certificate of Copyright Registration, United States Copyright Office. Mar. 3, 1987, Convertible Sports Hat, James E. Johnson, 4 sheets.

* cited by examiner

*Primary Examiner*—Bibhu Mohanty
(74) *Attorney, Agent, or Firm*—Dickinson Wright PLLC

(57) ABSTRACT

The present invention relates to a convertible visor/cap, which can be converted from a cap to a visor, and vice verse, having a fixed frontal crown portion and a folding crown membrane supported by a plurality of hinged support members. The visor/cap preferably has a forwardly extending bill, from which the frontal crown portion extends upward, and a head band portion extending rearwardly therefrom. Two hinges are preferably provided on the sides of the head band portion adjacent the frontal crown portion for pivotally supporting the support members. The hinges allow the support members to be pivoted between a first extended position, in which the membrane covers the head (i.e., to form a cap), and a second folded position, in which the membrane is folded up behind the frontal crown portion and substantially hidden from view (i.e., to form a visor).

15 Claims, 3 Drawing Sheets

CONVERTIBLE VISOR/CAP WITH A PLURALITY OF CROWN SUPPORTS

FIELD OF THE INVENTION

The present invention relates to the field of hats, and in particular, to the field of convertible visor/caps with a folding crown.

BACKGROUND OF THE INVENTION

Convertible sunvisor/caps have been developed in the past, such as shown in U.S. Pat. Nos. 4,556,993 and 4,741,053. Each of these caps have a foldable material that can be extended over the crown. The material can be extended from a folded position, in which the cap is adapted as a sunvisor, and an extended position, in which the cap is adapted as a cap. There were several problems associated with these designs. For example, the foldable material had to be gathered at opposite sides of the cap. Also, the material had no additional supports to form the shape of the crown, other than the support band around the back side, wherein the user's head was needed to support the crown.

The McKee et al. patent, U.S. Pat. No. 1,665,750, was also directed to a convertible visor/cap, wherein an auxiliary head cover attachment was provided that could be extended from a folded position to form a visor, back over the head to form a cap. While this patent disclosed a convertible visor/cap, the same problems existed, i.e., no crown supports were provided.

SUMMARY OF THE INVENTION

The present invention relates to a convertible visor/cap, i.e., which can be converted from a cap to a visor, and vice verse, having a fixed frontal crown portion and a folding crown membrane supported by a plurality of hinged support members. The visor/cap preferably has a forwardly extending bill, from which the frontal crown portion extends upward, and a head band portion extending rearwardly therefrom. Two hinges are preferably provided on the sides of the head band portion adjacent the frontal crown portion for pivotally supporting the support members. The hinges allow the support members to be pivoted between a first extended position, where the membrane covers the head (i.e., to form a cap), and a second folded position, where the membrane is folded up behind the frontal crown portion and substantially hidden from view (i.e., to form a visor).

The support members are preferably adapted to be provided in different lengths, such that they can be folded up over each other, which allows the membrane to be easily folded and unfolded when necessary. In the preferred embodiment, there are preferably three support members which allow the membrane to be moved between the first and second positions. The rearward-most support member is preferably adjustable in length and adapted such that it can overlap the head band portion (in the first position). One or more snaps can be provided to enable the rearward-most support member to be secured to the head band portion in the first position. The membrane is preferably secured to all three support members, with the back edge of the membrane being secured to the rearward-most support member, and the front edge of the membrane being secured to the frontal crown portion, wherein the membrane in between is secured to the forward-most and middle support members.

In the preferred embodiment, the middle support member is longer than the forward-most support member so that the forward-most support member can be folded under the middle support member when the membrane is folded in the second position, i.e., to form a visor. In such case, the rearward-most support member is also preferably adapted to be adjusted so that it is short enough to be folded under the forward-most support member, such that the rearward-most support member can be folded up under both the middle and forward-most support members. In this respect, the rearward-most support member is preferably adjustable such that it can be extended or contracted as needed. This structure advantageously allows the support members to be easily folded and unfolded, while providing the proper balance appearance-wise.

The head band portion preferably extends rearward from the frontal crown portion and has an adjustable strap and rear section that extends around the back. The strap and rear section can be made adjustable, such as by Velcro™, so that the visor/cap can be fitted onto different size heads.

DETAILED DESCRIPTION OF THE INVENTION

Figure 1:
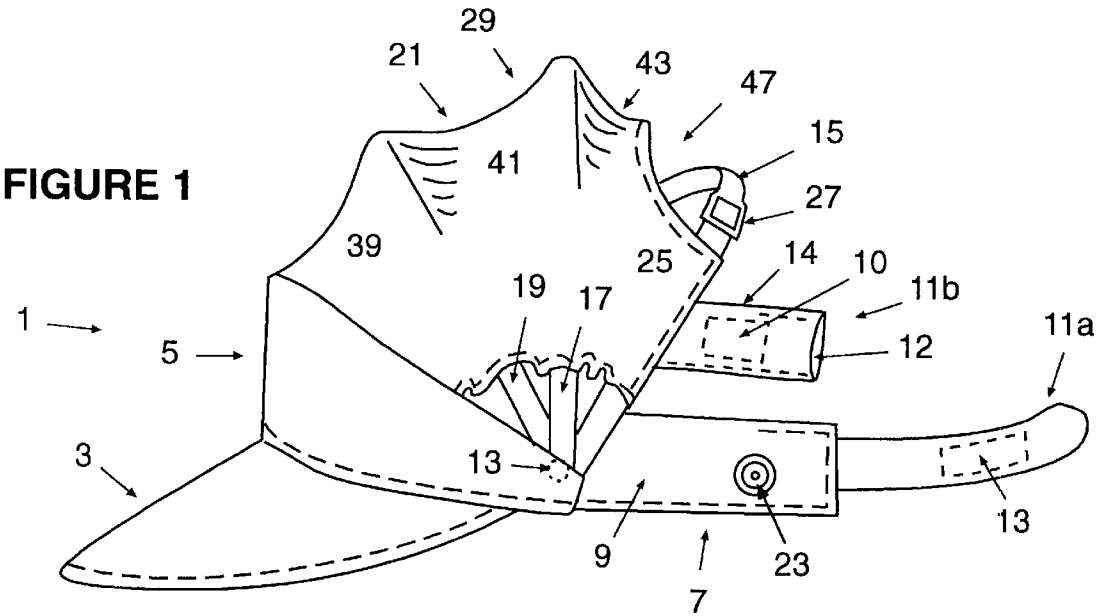
FIG. 1 is a side perspective view of the present invention with the crown partially folded.
Figure 2:
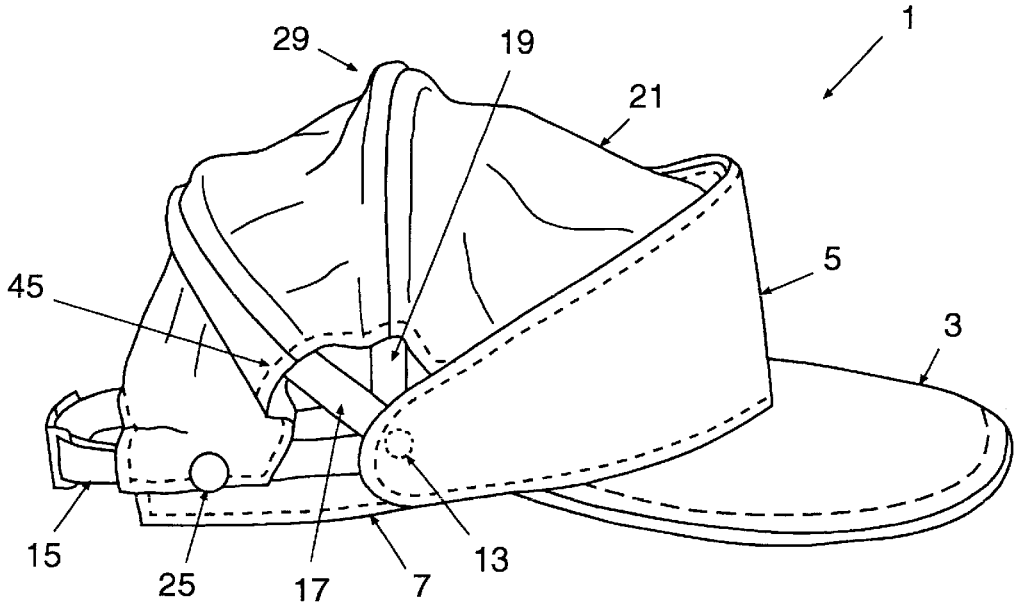
FIG. 2 is a side perspective view of the present invention with the membrane extended over the crown.
Figure 3:
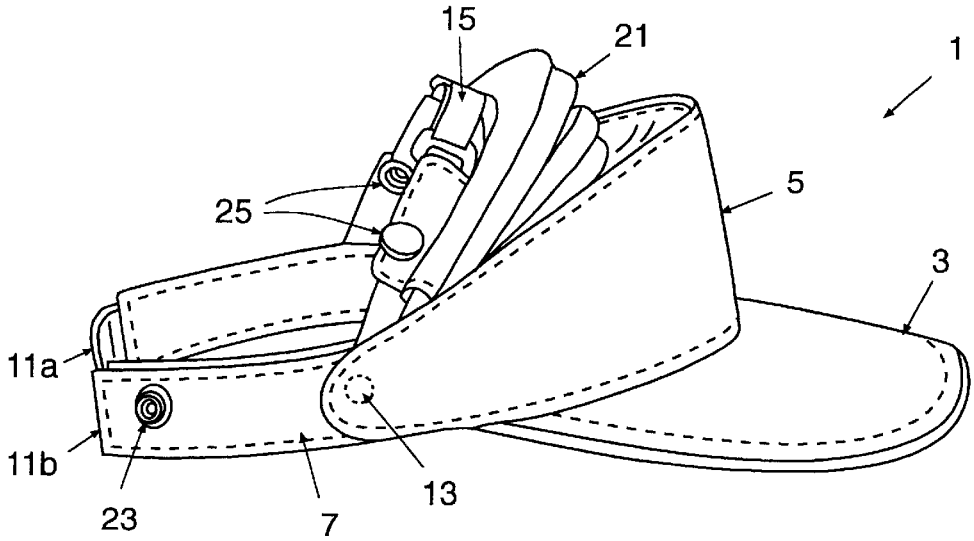
FIG. 3 is a side perspective view of the present invention with the membrane folded up behind the frontal crown portion.

FIGS. 1, 2 and 3 represent side perspective views of the present visor/cap invention 1 having a forwardly extended bill 3 and a front crown portion 5 extending upwardly therefrom. A head band portion 7 extends around the inside surface of the front crown portion 5 and rearwardly therefrom. The head band portion 7 has a front portion 9 and an adjustable strap 11*a*, on one side, and rear section 11*b*, on the other side. At or near the junction of the front crown portion 5 and head band portion 7, there are preferably two hinges 13, one on either side of the visor/cap 1. The hinges 13 are preferably located on the head band portion 7, and covered by the lower part of the front crown portion 5.

Figure 5:
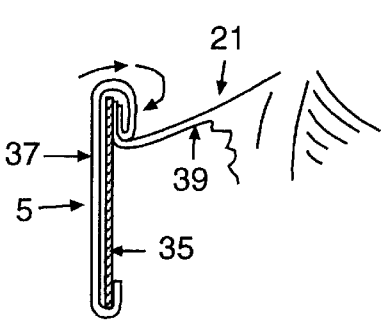
FIG. 5 is a section view of the front crown portion and membrane.

A plurality of support members, 15, 17 and 19 are preferably adapted to be pivotally secured to and extended between the hinges 13, in a relatively bowed manner over the crown portion 29. A membrane 21 is preferably secured to the support members 15, 17 and 19, by stitching and the like, as well as the top edge of the front crown portion 5, as shown in FIGS. 1 and 5, such that it can be extended over the crown portion 29, as shown in FIG. 2. In this respect, the support members, 15, 17 and 19 are preferably adapted to be pivoted between a first extended position, as shown in FIG. 2, where the membrane 21 covers and extends over the crown portion 29 (i.e., to form a cap), and a second folded position, as shown in FIG. 3, where the membrane 21 is folded up behind the front crown portion 5 (i.e., to form a visor).

Figure 7:
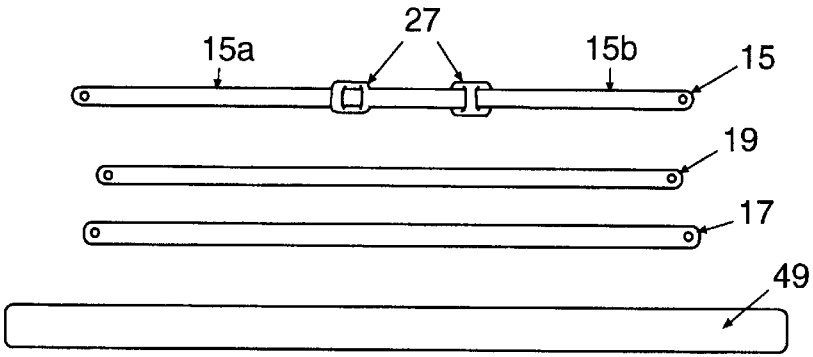
FIG. 7 shows the three support members and internal structure of the head band portion laid flat.

The support members 15, 17 and 19 are preferably adapted to be in different lengths. In the preferred embodiment, for example, there are three support members, although less than 3 or more than 3 can be provided if desired. Support member 17, which is the middle support member, is preferably the longest support member, as shown in FIG. 7. Support member 19, which is the forward-most support member, is preferably the shortest support member. The other support member 15, which is the rearward-most support member, is preferably adjustable so that it can be extended to a length that is greater than support member 17, or contracted to a length that is shorter than support member 19.

When the support members, 15, 17 and 19 are in their first extended positions, as shown in FIG. 2, support member 15 is preferably extended substantially horizontally and rearward and over the exterior periphery of the head band portion 7, i.e., with the head band portion 7 adjusted and fitted onto the head of the user, as will be discussed. In this respect, there are preferably two snaps 23 located on the head band portion 7 at the appropriate locations which can be to connected to two corresponding snaps 25 located on the support member 15, to secure the support member 15 to the head band portion 7. The corresponding snaps 23 and 25 are preferably located on the head band portion 7 and support member 15, respectively, to enable them to be easily connected to each other.

Support member 15 is preferably adjustable, such as by the means shown in FIG. 7, wherein the support member 15 is made of two separate pieces, 15*a* and 15*b*, wherein at the end of each one there is a loop 27 with two slits through which the other piece can be extended. This way, the two pieces can be movably secured to each other such that the length of the support member 15 can be adjusted by either pulling or pushing on the two pieces 15*a* and 15*b* through the respective loop ends 27.

The support members 15, 17 and 19 are adapted such that they can be folded under each other in a predetermined order when the membrane 21 is folded behind the front crown portion 5 in the second folded position, i.e., to form a visor as shown in FIG. 3. Preferably, support member 17 is longer than support member 19, such that support member 19 can be folded under support member 17, i.e., adjacent the top end of the front crown portion 5. Likewise, support member 15 is preferably adapted so that it can be contracted to fit under support member 19. In this way, the three support members can be folded up one on top of each other, adjacent the front crown portion 5, to form the visor shown in FIG. 3.

Figure 4:
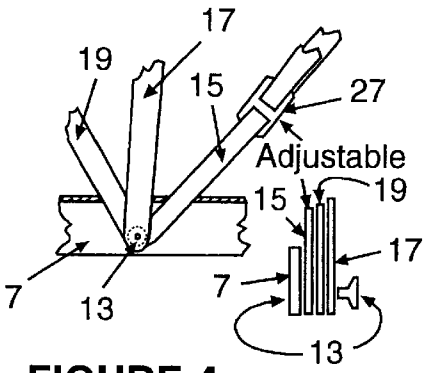
FIG. 4 is a side and cut-away view showing the hinge.

In order to allow the support members to be folded in the manner described above, the support members 15, 17 and 19 are preferably connected at the hinges 13 in the order shown in FIG. 4. For example, support member 15 is connected to the hinges 13 closest to the head band portion 7, and support member 19 is connected over support member 15, followed by support member 17, which is the longest member. When other arrangements are used, the support members can be connected in any manner that allows them to be folded in the desired way.

Although more or fewer support members can be used, and support members of different lengths in different orders are contemplated by the present invention, the preferred order of the support members 15, 17 and 19 described above achieves the desired results. In this respect, not only does the order of the support members described above enable the support members to be easily folded under each other, and the membrane 21 to be folded relatively compactly, it also provides the present invention 1 with the desired balance appearance-wise. Had the forward-most support member 19 been the longest support member, that could have made the crown portion 29 appear disproportionately high on top.

Support members 15, 17 and 19 are preferably made of a flexible material such as plastic which tends to bow upward in a concave manner when held between the two hinges 13. The support members themselves do not have to be bowed in configuration. They are preferably made of a flat material that is adapted so that by placing them in tension between the two hinges 13, they will automatically bow upward to form a curvilinear crown portion 29.

Figure 8:
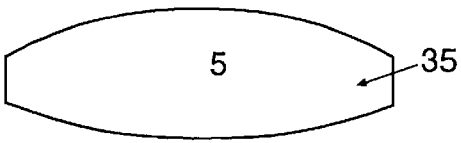
FIG. 8 shows the internal structure of the bill and front crown portion.
Figure 8:
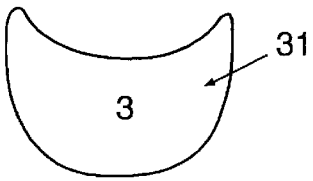
Figure 8:
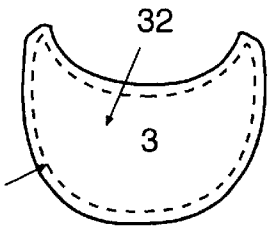
Figure 9:
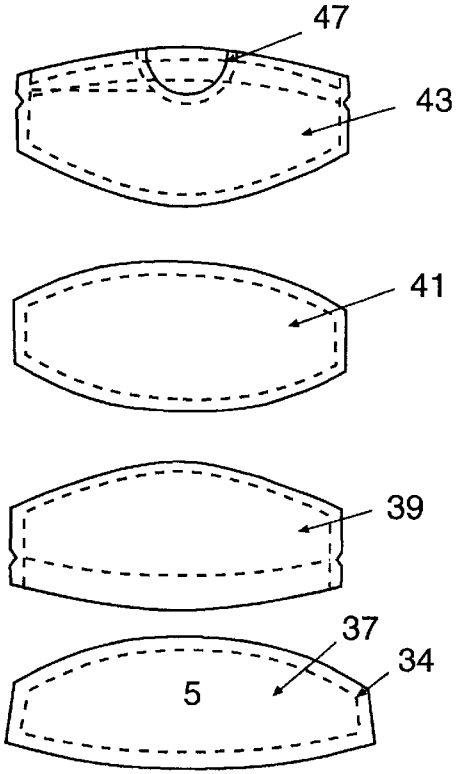
FIG. 9 shows the cloth materials and stitching for the front crown portion and membrane sections.
Figure 10:
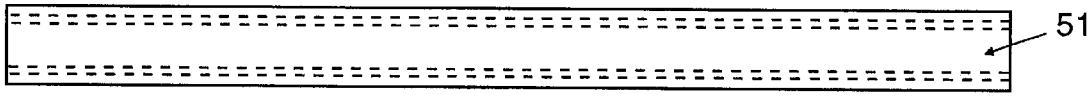
FIG. 10 shows the cloth materials for the bill and head band portion.

The components of the visor/cap 1 of the present invention are preferably made of an internal flexibly rigid material, such as plastic, covered by an exterior fabric, such as cloth material, which is then secured, such as by stitching, to the internal structure. For example, the bill portion 3 is preferably made of an internal structure 31, as shown in FIG. 8, and covered by a fabric, such as cloth 32, and provided with stitching around the edges 33, as shown in FIG. 10. Likewise, the front crown portion 5 can be made of an internal structure 35, as shown in FIG. 8, and covered by a similar fabric material 37 and bound by stitching 34, as shown in FIG. 9. Each of the support members 15, 17 and 19 are preferably made of the same flexibly resilient material, i.e., plastic, but do not need to be completely encased in fabric.

The membrane 21 is preferably secured along its front edge to the top edge of the front crown portion 5, as shown in FIG. 5. Fabric 37, as shown in FIG. 9, is preferably extended over the upper edge of the internal structure 35, and then sewn along the edges, together with the first section 39 of the membrane 21, as shown in FIG. 9, which extends between the front crown portion 5 and forward support member 19. The membrane 21 is further comprised of two additional sections of fabric, 41 and 43, as shown in FIG. 9, wherein fabric 41 is preferably connected to and extended between support members 19 and 17, and fabric 43 is preferably connected to and extended between support members 15 and 17, as shown in FIG. 1. The fabric sections 39, 41 and 43 are preferably sewn into the respective support members 19, 17 and 15, such that the membrane 21 appears to be contiguous. A single fabric that is adapted to cover the crown portion 29 could also be used.

The membrane 21 is preferably cut back 45 nearest the hinges 13, as shown in FIGS. 1 and 2, which allows the support members to pivot about the hinges 13 without gathering too much of the membrane material. Moreover, the last membrane section 43 is preferably provided with a cutout section 47, which allows access to the adjustable features of the support member 15, and serves at a venting means for the visor/cap 1.

Figure 6:
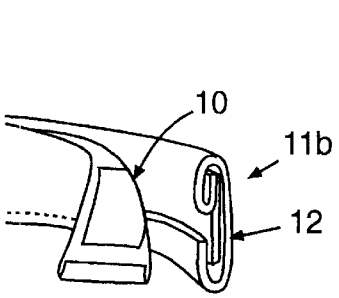
FIG. 6 is a close-up view of the rear section with Velcro™ fastener.

The head band portion 7 is preferably extended forward along the inside of front crown portion 5, and extended rearward on opposite ends thereof. In the preferred embodiment, the front portion 9 of the headband 7 is relatively wide and constructed using an internal structure 49, as shown in FIG. 7, made from the same materials as the other internal structures, and covered by a similar fabric 51, as shown in FIG. 10. Extending rearward from either side of the front portion of the head band portion 7 is an adjustable strap 11*a* and rear section 11*b*, one on either side, having fastening means such as Velcro™ 10 attached thereto. Velcro™ 10 can be provided on one or the other of strap 11*a* and rear section 11*b*. For example, it can be provided on one side of rear section 11*b*, as shown in FIG. 6, or the inside of strap 11*a* (the side facing the cap). When the Velcro™ is on the rear section 11*b*, it is preferably set inside two layers of material, and facing inward, as shown in FIG. 6, wherein there is an opening along the end 12 into which strap 11*a* can be inserted to enable the connection between the two pieces to be made. That is, strap 11*a* can be inserted into opening 12 such that the Velcro™ surface 10 on the rear section 11*b* can engage the corresponding surface of the strap 11*a*, to secure the head band portion 7 at the desired length. When strap 11*a* is inserted far enough into the opening 12, the Velcro™ surface 10 can engage the corresponding surface of the other piece to secure the two pieces together. An additional slit 14 is preferably provided along the upper edge of the rear section 11*b*, so that access to the Velcro™ surface 10 is made possible, wherein adjustments can easily be made. Other fastening means are contemplated by the present invention.

In use, the visor/cap 1 of the present invention enables a user to adjust the crown portion 29 to form either a visor, as shown in FIG. 3, wherein the membrane 21 is folded up under the front crown portion 5, or a cap, as shown in FIG. 2, wherein the membrane 21 is extended over the crown portion 29. To be used as a cap, the user simply has to adjust and extend the support member 15, and then pull support member 15 and membrane 21 back behind the head band portion 7. The user can then line up and apply pressure to the snaps 23 and 25 to secure the support member 15 to the head band portion 7, wherein the membrane 21 can be secured in the first extended position to form a cap. Pulling the support member 15 in this manner pulls the other support members 17 and 19 to the appropriate positions, along with membrane 21.

When it is desirable for the user to use the present invention as a visor, the user simply has to release the snaps 23 and 25 and fold the support members forward until they are folded under each other against the front crown portion 5. This can best be done by first contracting the rear support member 15 such that it is shorter than the forward support member 19, wherein the support member 19 can then be folded under the support member 17, and the support member 15 can then be folded under the support member 19. With the membrane 21 folded up against the front crown portion 5 in this manner, the cap 1 of the present invention can be worn as a visor, i.e., without membrane 21 extending over the crown 29.

The visor/cap 1 of the present invention can also be adjusted to fit different size heads using the adjustable strap 11*a* and rear section 11*b*. As discussed before, either the strap 11*a* or rear section 11*b* can have a Velcro™ surface 10 that can be used to secure the pieces together at the desired length. This way, the strap 11*a* can be inserted into the opening 12 and secured to the Velcro™ surface 10 at the appropriate position, wherein the visor/cap 1 of the present invention can be adjusted to the appropriate head size.

The present invention has been described in terms of the preferred embodiments thereof. Nevertheless, it is contemplated that various features and embodiments not specifically disclosed herein are still within the scope of the present invention.

What is claimed is:

1. A convertible hat capable of being adjusted from a first position, in which the hat serves as a visor, and a second position, in which the hat serves as a cap, comprising:

a bill portion;

a frontal crown portion extending upward from said bill portion, said frontal crown portion being fixed relative to said bill portion;

a head band portion capable of extending backward from said frontal crown portion;

two hinges and a plurality of support members extending from said hinges, wherein a crown membrane is connected to said support members and adapted to be folded between said first and second positions.

2. The hat of claim 1, wherein said support members have varying lengths, such that they can be folded under each other and positioned relatively snug adjacent said frontal crown portion in said first position, and wherein said support members can be separated from each other and extended with said membrane thereon to form an extended crown in said second position.

3. The hat of claim 1, wherein said head band portion is adjustable.

4. The hat of claim 1, wherein said hat has first, second and third support members for supporting said membrane, wherein said first support member is adjustable and is adapted to be connected to the back of said membrane.

5. The hat of claim 4, wherein said first support member is adapted such that it can be located on the outer periphery of said head band portion when said hat is in said second position.

6. The hat of claim 5, wherein said first support member can be secured to said head band portion by one or more snaps.

7. The hat of claim 4, wherein said third support member is adapted to be the forward-most support member, and said first support member is adapted to be the rearward-most support member, wherein said second support member is adapted to be extended between said first and third support members.

8. The hat of claim 7, wherein said second support member is longer than said third support member, and wherein said first support member is adjustable such that it can be made longer than said second support member or shorter than said third member.

9. The hat of claim 1, wherein the support members are constructed from plastic sheets and are bowed in a curved manner under tension between said hinges to form a curved crown in said second position.

10. The hat of claim 4, wherein two snaps are provided on said first support member, wherein said snaps are adapted to be secured to corresponding snaps located on said head band portion for securing said membrane and said hat in said second position.

11. The hat of claim 1, wherein the head band portion is adjustable in length and can be secured by a hook and loop fastener.

12. The hat of claim 4, wherein said first support member is adjustable by virtue of interlocking sections that enable a first section of said first support member to be moved in relation to a second section of said first support member.

13. A method of converting a cap to a visor, and vice verse, comprising:

providing a cap with a bill portion, and a frontal crown portion extending upward from said bill portion, said frontal crown portion being fixed relative to said bill portion;

extending a head band portion backward from said frontal crown portion;

providing two hinges and extending a plurality of support members from said hinges;

extending a membrane from said frontal crown portion and onto said support members, wherein said membrane is adapted to be folded between first and second positions, wherein in said first position, said membrane is folded up to form said visor, and in said second position, said membrane extends over a crown portion to form said cap.

14. The method of claim 13, further comprising moving said support members together such that they are under each other and positioned adjacent said frontal crown portion to form said visor.

15. The method of claim 13, further comprising pulling said support members apart such that said membrane is in an extended position to form said crown portion for said cap.

* * * * *